US007601924B2

(12) United States Patent
Demirtas et al.

(10) Patent No.: US 7,601,924 B2
(45) Date of Patent: Oct. 13, 2009

(54) JOYSTICK

(75) Inventors: Dervis Demirtas, Delft (NL); Joeri Jonke Post, Rotterdam (NL); Jennigje Dankelman, Pijnacker (NL)

(73) Assignee: Technische Universiteit Delft, Delft (NL)

( * ) Notice: Subject to any disclaimer, the term of this patent is extended or adjusted under 35 U.S.C. 154(b) by 529 days.

(21) Appl. No.: 11/532,489

(22) Filed: Sep. 15, 2006

(65) Prior Publication Data

US 2007/0051593 A1 Mar. 8, 2007

Related U.S. Application Data

(63) Continuation of application No. PCT/NL2005/00172, filed on Mar. 9, 2005.

(30) Foreign Application Priority Data

Mar. 15, 2004 (NL) ..... 1025722

(51) Int. Cl.
*H01H 19/00* (2006.01)
*H01H 21/00* (2006.01)

(52) U.S. Cl. ..... 200/6 A; 200/6 R

(58) Field of Classification Search ..... 200/6 A
See application file for complete search history.

(56) References Cited

U.S. PATENT DOCUMENTS

| | | | | |
|---|---|---|---|---|
| 4,473,725 | A * | 9/1984 | Kim | 200/6 A |
| 4,639,667 | A | 1/1987 | Andresen | |
| 4,763,100 | A | 8/1988 | Wood | |
| 5,235,868 | A | 8/1993 | Culver | |
| 6,037,927 | A | 3/2000 | Rosenberg | |
| 6,064,369 | A * | 5/2000 | Okabe et al. | 345/161 |
| 6,101,893 | A * | 8/2000 | Wergen | 74/471 XY |
| 6,177,640 | B1 * | 1/2001 | Okabe et al. | 200/6 A |
| 6,307,535 | B1 | 10/2001 | Kim et al. | |
| 7,148,880 | B2 * | 12/2006 | Magara | 345/161 |
| 2001/0020937 | A1 | 9/2001 | Rosenberg et al. | |

FOREIGN PATENT DOCUMENTS

| | | |
|---|---|---|
| DE | 19736086 | 11/1998 |
| EP | 0790488 | 8/1997 |

* cited by examiner

*Primary Examiner*—Renee S Luebke
*Assistant Examiner*—Lheiren Mae A Anglo
(74) *Attorney, Agent, or Firm*—Jeffrey D. Myers; Samantha A. Updegraff; Peacock Myers, P.C.

(57) ABSTRACT

An apparatus for the manual control of remote controlled objects in real or virtual spaces, more specifically a joystick, is equipped with two control mechanisms (8, 9), each of which allowing complementary manual navigation in the x and y direction, coupled with each other in such a manner as to additionally allow a movement of the control mechanisms (8, 9) in relation to each other in the z direction.

1 Claim, 1 Drawing Sheet

JOYSTICK

CROSS-REFERENCE TO RELATED APPLICATIONS

This application is a continuation application of Patent Cooperation Treaty (PCT) Patent Application Ser. No. PCT/NL2005/000172, entitled "JOYSTICK", to Technische Universiteit Delft, filed on Mar. 9, 2005, and the specification and claims thereof are incorporated herein by reference.

This application claims priority to and the benefit of the filing of Netherlands Patent Application Serial No. 1025722, entitled "JOYSTICK", filed on Mar. 15, 2004, and the specification and claims thereof are incorporated herein by reference.

BACKGROUND OF THE INVENTION

1. Field of the Invention (Technical Field):

The invention relates to a joystick having more than two degrees of freedom, at least designed for movement in the x and y direction at right angles to a longitudinal axis thereof, and in a rotational direction around said longitudinal axis.

2. Description of Related Art:

Such a joystick is known from the European patent specification EP-B-O 790 488.

The known joystick is moveable in the x and y direction as well as in a rotational direction around the axis of the joystick, and is used for controlling a helicopter.

To determine the movement of the joystick in the rotational direction it possesses a detector that uses light signals, and an identifiable mosaic pattern working together with these light signals, wherein the rotational movement of the joystick can be derived through the detection of said pattern. As already known, the movement in the x and y direction can be determined by using electromagnetic means.

In practice, there is a demand for an inexpensive joystick that can be used for the training of hand-eye coordination such as is relevant for endoscopic operations and virtual endoscopy.

To this end the U.S. patent application 2001/00209737 proposes a device in accordance with the preamble, which possesses a fourth degree of freedom in the direction of the longitudinal axis.

The device known from this publication is provided with a handle for manual operation.

From DE-A-19736086, a joystick according to the preamble is known, which comprises a first tubular member surrounded by a second tubular member, wherein the first tubular member is designed for movement in the x and y direction and wherein the second tubular member is designed for sliding along and rotating around the first tubular member.

DETAILED DESCRIPTION OF THE INVENTION

The joystick according to the invention is characterized in that the first tubular member and the second tubular member are equipped with a sensor and an identification means suitable for detection by the sensor, respectively.

This joystick according to the invention is inexpensive, is accurate and effective and very reliable.

The identification means is preferably a grid.

Without limiting the appended claims, the invention will be further elucidated herein below by way of an exemplary embodiment of the joystick according to the invention, and with reference to the drawing.

BRIEF DESCRIPTION OF THE SEVERAL VIEWS OF THE DRAWINGS

In the drawing, a single figure numbered 1 shows the joystick according to the invention.

This joystick 1 possesses more than two degrees of freedom, namely apart from the known degrees of freedom in the directions indicated with arrows x and y, also a degree of freedom in a rotational direction ω around a longitudinal axis 2 of the joystick 1. The joystick 1 according to the invention further possesses a fourth degree of freedom in the direction of said longitudinal axis 2, indicated with arrow z.

Figure 1:
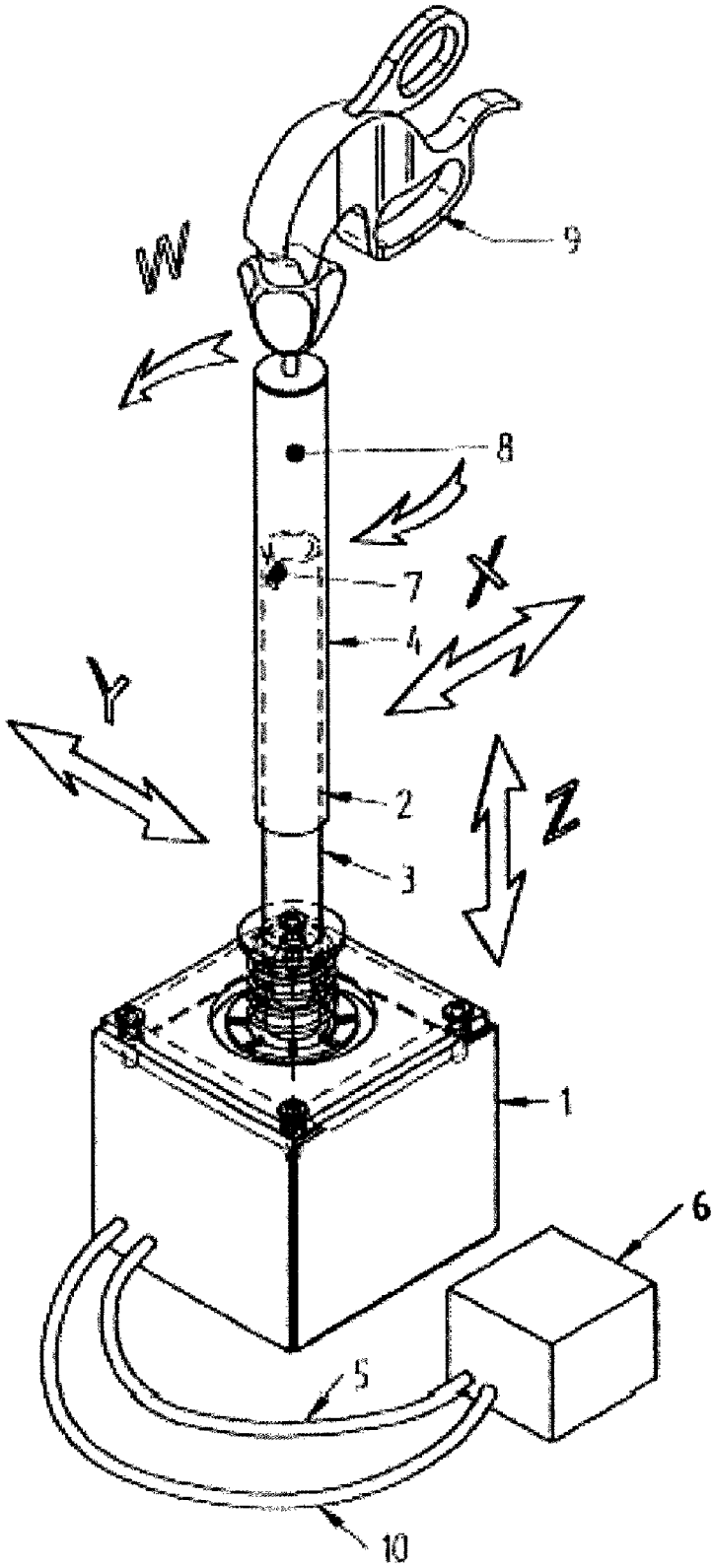

The joystick 1 according to the invention is provided with a handle 9 for manual operation, which is constructed such that the same possesses a first tubular member 3 and a second tubular member 4 surrounding said first tubular member 3.

In order to allow the joystick 1 according to the invention to fulfill its function, the first tubular member 3 is designed for movement in the x and y direction and the second tubular member 4 is designed for sliding along and rotating around the first tubular member 3.

In a manner well-known, the movement of the first tubular member 3 effected by operating the second tubular member 4 and the thus resulting movement in the x and y direction, can be detected and converted into electrical signals, which are conducted via a cable 5 to a computer 6 for further processing.

To detect the movement of the second tubular member 4 in the z-direction and in the rotational direction ω around the longitudinal axis 2 of the joystick 1, a sensor 7 may be provided that works together with an identification pattern, e.g. a grid pattern 8, which is detectable by the sensor 7. In the situation shown, the sensor 7 is to this end mounted on the first tubular member 3, while the grid 8 is provided on the second tubular member 4. Of course, the position of the two may conceivably also be interchanged. Via a cable 10, the obtained measuring signals are fed to the computer 6 for further processing.

What is claimed is:

1. A joystick having more than two degrees of freedom, at least designed for movement in the x and y direction at right angles to a longitudinal axis thereof, and in a rotational direction ω around said longitudinal axis, and provided with a fourth degree of freedom in the direction of the longitudinal axis, and comprising:

a handle for manual operation, the handle comprising a first tubular member surrounded by a second tubular member;

wherein the first tubular member is designed for movement in the x and y direction;

wherein the second tubular member is designed for sliding along and rotating around the first tubular member, wherein the first tubular member and the second tubular member are equipped with a sensor and an identification means suitable for detection by the sensor so as to detect the relative position of the first tubular member and the second tubular member in both said rotational direction around said longitudinal axis and in the direction of said longitudinal axis; and wherein the identification means comprises a grid.

* * * * *